US006588150B1

(12) United States Patent
Wong et al.

(10) Patent No.: US 6,588,150 B1
(45) Date of Patent: Jul. 8, 2003

(54) ROTATABLE ACTUATOR FOR LATCHES OF A WINDOW SASH

(75) Inventors: Lenny Wong, Warroad, MN (US); Leslie B. Hendrickson, Roseau, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 09/450,648

(22) Filed: Nov. 23, 1999

(51) Int. Cl.[7] ..... E05D 15/22

(52) U.S. Cl. ..... 49/183; 49/449; 49/301; 49/185

(58) Field of Search ..... 49/183, 184, 449, 49/395, 301, 279, 447, 396, 185; 292/34, 33, 36, 51, 6, 67, 203, DIG. 20, DIG. 35

(56) References Cited

U.S. PATENT DOCUMENTS

| | | | | | |
|---|---|---|---|---|---|
| 480,148 | A | * | 8/1892 | Theby | |
| 1,909,697 | A | * | 5/1933 | MacBeth et al. | |
| 2,670,982 | A | * | 3/1954 | Banham | |
| 3,027,188 | A | * | 3/1962 | Eichstadt | |
| 4,949,506 | A | * | 8/1990 | Durham, Jr. | 49/449 |
| 5,072,464 | A | * | 12/1991 | Draheim et al. | 5/93.1 |
| 5,169,205 | A | * | 12/1992 | James | 296/146 N |
| 5,398,447 | A | * | 3/1995 | Morse | 49/185 |
| 5,406,749 | A | * | 4/1995 | Goldenberg | 49/178 |
| 5,582,472 | A | * | 12/1996 | Lyons et al. | 312/324 |
| 5,911,763 | A | | 6/1999 | Quesada | |
| 5,992,907 | A | * | 11/1999 | Sheldon et al. | 292/34 |
| 6,141,913 | A | * | 11/2000 | Wong et al. | 49/465 |

FOREIGN PATENT DOCUMENTS

| | | |
|---|---|---|
| FR | 2715429 | 7/1995 |

* cited by examiner

*Primary Examiner*—Gregory J. Strimbu
(74) *Attorney, Agent, or Firm*—Schwegman, Lundberg, Woessner & Kluth, P.A.

(57) ABSTRACT

A window assembly includes a housing and a winder rotatably connected to the housing, where the winder includes a slot. The housing is mounted on a window sash. A flexible filament is disposed within the slot and is operative with the winder to withdraw window sash latches from a window frame so that the window sash can be removed from the frame.

19 Claims, 9 Drawing Sheets

ROTATABLE ACTUATOR FOR LATCHES OF A WINDOW SASH

TECHNICAL FIELD

The present invention deals broadly with the field of windows, and more particularly with those windows, such as double-hung windows, wherein a sash slides within a frame. The invention specifically relates to mechanisms for retaining a window sash within a frame at an intended location along an axis perpendicular to a plane defined by the window frame within which the sash slides, and more particularly to an actuator for such a sash retention mechanism.

BACKGROUND OF THE INVENTION

The prior art includes many types of windows which are employed to bring light into a building. One popular type of window known in the prior art is a double-hung window, and the background of the present invention will be described in that context (although it should be noted that the present invention can certainly be used with any tiltably removable sliding sash window and is not limited to double-hung windows).

A double-hung window typically employs two movable sash assemblies, each carrying its own pane of glass, which are typically movable vertically within the frame. For most double-hung windows it is highly desirable that the sashes be inwardly tiltable and/or removable, so that the glass portions of the sash assemblies can be easily cleaned. Various types of sash retention mechanisms have been utilized to effect maintenance of a sash in the desired position yet allow it to be tilted inwardly or removed for cleaning. The present invention is directed to a sash retention mechanism actuator, so the remainder to this background discussion will focus on such mechanisms.

One type of sash retention mechanism utilizes a pair of independently-operable latch elements carried by the sash. The latch elements extend laterally out of the sash and into a groove or track formed by the frame. One latch element extends laterally from one side of the sash, and a second latch element extends laterally from the other side of the sash. When it is desired to remove a sash, the person removing the sash releases (i.e., retracts the latch element back into the sash) one latch with one hand and releases the other latch with the other hand. The sash is then tilted or slid out of its normal position and removed from the frame for cleaning. Such an "independent-latch" sash retention mechanism has a number of drawbacks, not the least of which is that the person removing the window sash needs full availability of both hands to effect release of the latches.

To address problems associated with "independent-latch" sash retention mechanisms, attempts have been made to design a mechanism for concurrently releasing both latches (that is, for simultaneously effecting retraction of the latches). One such "concurrent-latch" sash retention mechanism is disclosed in commonly-assigned U.S. patent application Ser. No. 09/328,085, now U.S. Pat. No. 6,141,913. Latch elements (i.e., the elements that extend into the groove or track in the window frame) for "concurrent-latch" mechanisms can move in and out relative to the sash along a straight line or they can pivot in some fashion (as disclosed in the aforementioned commonly-assigned patent application), but regardless of the specific type of latch element being used, an actuator of some sort is necessary to draw the latch element out of the corresponding groove or track in the window frame so that the sash can be removed or tilted as necessary. The present invention relates in particular to an improved actuator for a "concurrent-latch" sash retention mechanism.

While "concurrent-latch" sash retention mechanisms are theoretically superior to "independent-latch" mechanisms due to the one-hand versus two-hand operation advantage discussed above, the actuators in prior art "concurrent-latch" mechanisms have been problematical. For example, one design, shown somewhat pictorially in FIGS. 1–4 hereof, uses a plastic strap captured by a winder to actuate a pair of linear latch elements (not shown).

In the "plastic-strap/linear-latch" design discussed immediately above and partially shown pictorially in FIGS. 1–4 hereof, the tilt actuator includes a tilt lever (not shown) mounted at the top of the sash (assuming for the purposes of this discussion that the double-hung window is in its typical, vertical orientation with the sashes sliding up and down rather than side to side). The tilt lever is connected to the upper end of a cylindrical winder which rotates about a vertical axis. The lower end of the winder fits into a round aperture formed by a housing contained within the sash frame.

In addition to the winder aperture, the housing also forms a pair of laterally extending channels that extend from the winder aperture to the outer lateral edges of the housing. The lower end of the winder, the end that rotates within the winder aperture, is slotted in a manner that would appear to be a screwdriver slot as viewed from the bottom. This slot is a simple, vertical-walled slot extending diametrally through the lower end of the cylindrical winder.

A plastic strap, of the type used to bind or bundle various materials, having a generally rectangular cross section, is received within the "screwdriver slot" in the lower end of the winder. Note that FIGS. 2–4 show only the edge of the strap, not its width. When the tilt lever is in its un-activated position the winder slot is aligned with the channels in the housing, as shown in FIG. 2. As the tilt lever is rotated, as shown in FIG. 3, the winder is supposed to evenly and equally act on the strap to simultaneously draw the linear latch elements inwardly and out of their corresponding grooves or tracks in the window frame, to permit tilting/removal of the sash.

While the strap-type actuator mechanism shown in FIGS. 1–4 is an advance over typical "independent-latch" mechanisms that require two-hand operation, it has certain limitations. One of its limitations is that it employs a housing, and another has to do with its use of a strap.

As noted above, one shortcoming of prior art strap-type sash retention mechanism actuators is that they include a "housing," defined herein as a component that receives the lower end of a winder and forms channels for laterally guiding the strap. An actuator housing such as that employed by prior art strap-type actuators is an unnecessary part (as compared to preferred embodiments of the present invention) that adds cost in and of itself, increases the assembly time and cost, and introduces an additional source of friction and binding for the strap, thus potentially making it more difficult to actuate the tilt mechanism.

While the housing of the prior art strap-type actuator design may cause certain problems, FIG. 4 shows what would happen if the housing in this particular design were omitted. Initially, when the tilt lever is in its normal, unactivated position, the slot in the lower end of the winder is aligned with the linear latch elements. See FIG. 2. If the housing were absent, movement of the tilt lever would cause the linear latches to move inwardly only minimally for a given incremental rotation of the winder. Most of this initial movement would be taken up with simply changing the orientation of the strap from straight (FIG. 2) to angled or tangential (FIG. 4). That is, initial movement of the tilt lever would tend to cause the strap to "take a tangential shortcut" and not result in linear movement of the strap in the sense of X degrees of rotation of the winder consistently resulting in Y inches of movement of the strap. Rather, the translation of winder rotation to latch movement would be quite non-linear, and this could be misleading or feel strange to the operator, who might only operate the tilt latch on rare occasion. The rationale for the housing, given the initial, unactivated orientation of the strap slot, can now be understood.

Another shortcoming of this type of actuator mechanism is that the housing can introduce additional friction on the strap, and this can result in binding of the mechanism and possibly strap breakage, over time.

Still another shortcoming of the strap type of "concurrent-latch" actuator discussed above is the strap itself, given that it can become twisted and bind at various locations within the sash, irrespective of whether a "housing" is employed.

It is to these dictates and shortcomings of the prior art that the present invention is directed. It is an actuator for a "concurrent-latch" sash retention mechanism which addresses these dictates and problems and provides solutions which make the invention a significant advance over prior art sash retention mechanism actuators of the "concurrent-latch" variety.

SUMMARY OF THE INVENTION

The present invention is an actuator device for unlatching a sash tilt latch which is intended to maintain a window sash, such as in a double-hung window, in an intended path of reciprocation during opening and closing of the window. At the same time, however, the latch can be retracted to release the sash from its position in the defined path and allow it to be tilted for cleaning or removal. In a preferred embodiment, a pair of latches which extend oppositely in lateral directions are actuated by the structure. The actuator includes a housing which is mounted to the sash. A winder is rotatably connected to the housing and extends into an interior cavity within the sash. The winder has a longitudinal axis and forms a diametral slot. A flexible cord having a substantially round. cross-section is slidably received within the winder slot. Ends of the cord are connected to the latches. As the winder is rotated in a particular direction, the cord coils around the winder to draw the latches inwardly. The sash is, thereby, released from the frame.

In a preferred embodiment of the invention, the winder includes a slit at its lower end, the slit extending through an imaginary vertical axis about which the winder rotates.

The flexible cord is received within the slit, and, in a preferred embodiment, the cord has a larger diameter than does at least a portion of the slit. A bulge in the slit above its narrowest portion does, however, have a diameter greater than that of the cord. Consequently, prongs defined on opposite sides of the slit can be urged apart to admit the cord into the bulge. With the cord received in the bulge, because of the bulge's greater diameter than that of the cord, the cord will be free to move through the bulge portion of the slit and will effectively equalize pressure applied to the oppositely facing tilt latches.

The present invention is thus improved apparatus to be employed in mounting and maintaining a sash within a window frame. More specific features and advantages obtained in view of those features will become apparent with reference to the accompanying drawing figures, the DETAILED DESCRIPTION OF THE INVENTION, and appended claims.

DETAILED DESCRIPTION OF THE INVENTION

The present invention, as discussed above, is directed to a "concurrent-latch" actuator for a sash retention mechanism. An exemplary latch mechanism is disclosed, followed by preferred embodiment(s) of the actuator structure of the present invention.

Exemplary Latch Mechanism

Figure 5:
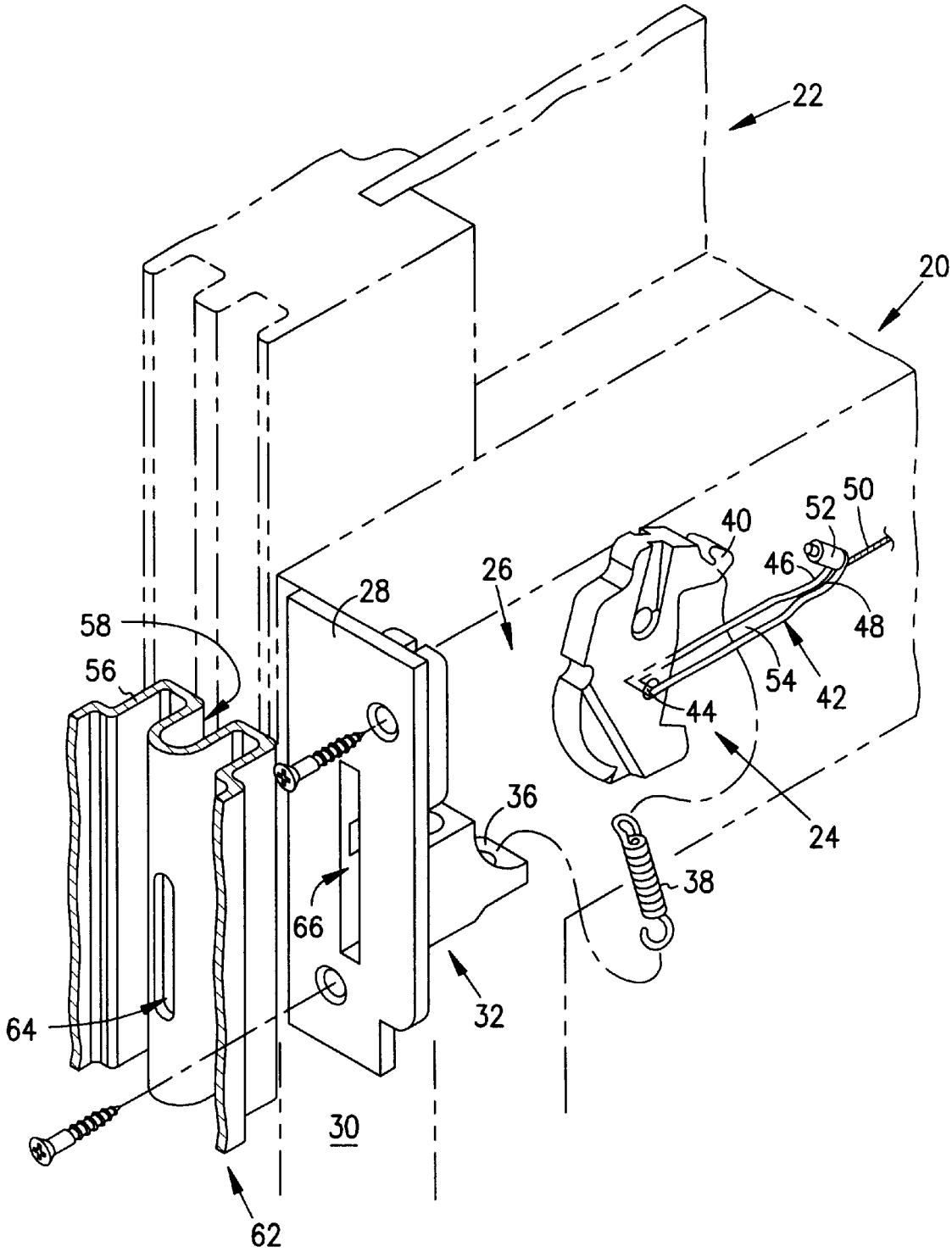
FIG. 5 is a perspective, exploded view of one type of latch assembly suitable for use with an actuator according to the present invention, including a pivoting "blade" and its supporting and related apparatus and structure, with the window sashes and actuator cord being shown in phantom, and some portions of the structure being broken away.

Referring now to the drawings, wherein like reference numerals denote like elements throughout the several views, FIG. 5 is an exploded view illustrating dual sashes 20, 22 of a double hung window and a pivoting blade 24, which is intended to be recessed within a cavity 26 in the inner sash 20. The cavity 26 in the sash 20 is overlain, on a side of the sash, by a face plate 28 mounted generally flush with the outwardly facing side surface 30 of the sash 20. The face plate 28 is part of an end plate assembly 32.

The figures illustrate a blade member 24 which is pivotally mounted for rotation about an axis generally transverse to a plane defined by the window sash 20. It should be noted, however, that the actuator of the present invention, discussed below, could be used with other types of latch elements, including without limitation linearly acting latch elements as opposed to pivoting blade(s) 24.

FIG. 5 illustrates a coil spring 38 which is shown as being connectable, at one end thereof, to a hook member 40 of the blade 24. The other end of the coil spring 38 is connectable to the base 36 of the end plate assembly 32. The coil spring 38, thereby, biases the blade 24 for rotation, in a direction as seen in FIG. 5, in a clockwise direction.

A yoke member 42 is attached to the blade 24 to effect selective overcoming of the bias of the coil spring 38 in order to retract the blade 24 for a purpose discussed hereinafter. The yoke member 42 is illustrated as being constructed of a wire stock formed into a bail, opposite ends of which are passed through an aperture 44 provided in the blade 24. The bail 42 thereby has an end, proximate the blade 24, which serves to apply force to the blade 24 in a direction, as viewed in FIG. 5, counter clockwise so as to overcome the bias of the coil spring 38. The wire from which the bail 42 is formed is provided with a narrow neck 46 at an end remote from blade 24. The neck 46 defines a channel 48 which extends away from the blade 24, when the bail 42 is connected to the blade 24, to facilitate connection of an actuator mechanism. A remote end of the actuator is illustrated in FIG. 5. A segment of flexible filament or cord 50 is shown as extending through the narrowed channel 48 formed in the neck 46, an end of the filament 50 having a sleeve 52 crimped onto the filament 50. Typically, the sleeve 52 would have a diameter smaller than an expanded channel 54 formed within the bail 42 so that the filament 50 end, with the sleeve 52 crimped thereon, could be slid through the expanded channel 54 and then withdrawn into the narrowed channel 48 which would have a width smaller than the diameter of the sleeve 52. The remainder of the actuator structure (i.e., the parts in addition to the filament or cord 50) is discussed in detail below.

FIG. 5 also illustrates a portion of a balance tube 56 which defines an elongated trough or track 58 into which blade 24 extends when in its non-fully-retracted position(s).

FIG. 5 illustrates a slot 64 formed in the balance tube 56 at the bottom of the trough 58. This slot 64 is formed at a location such that, when the window sash mechanisms are in their closed positions, a corresponding slot 66 in the end plate assembly face plate 28, through which the blade member 24 can extend, is registered with the slot 64 formed in the balance tube trough 58.

Figure 6:
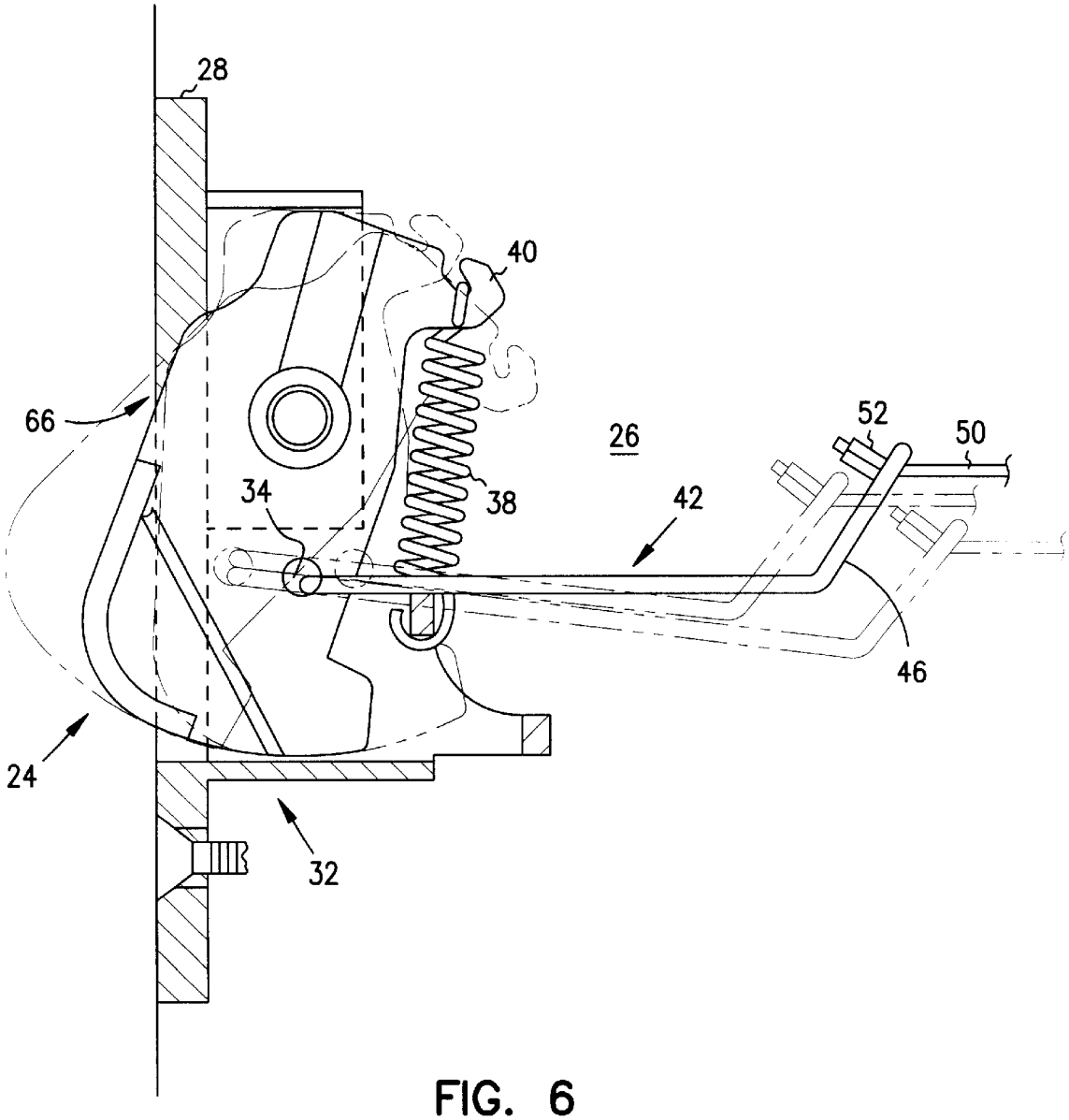
FIG. 6 is a front elevational view of the latch assembly of FIG. 5, as mounted within a window sash, showing the latch element in various positions.

FIG. 6 illustrates the blade 24 mounted to end plate assembly 32. That figure shows a second position of the blade 24 in solid line and first and third positions of the blade 24 in phantom line.

The first position of the blade 24 is such that the blade 24 is fully retracted within sash cavity 26. The third position of the blade 24 is one wherein the blade 24 not only extends into the trough 58 engaging the bottom thereof, as it does in its second position, but wherein the blade 24 extends fully to the bottom of the trough 58 and into and through the slot 64 formed in the bottom of the trough 58.

When the blade member 24 is in its second position, it will ride in the trough 58 and facilitate raising and lowering of the window sash 20. It serves as a track rider which rides on the track defined by trough 58, and the thickness of the blade member 24 can be made so that there is a minimum, if any, wobble of the sash 20 relative to the window frame 62 of which balance tube 56 is a part. Because of the biasing of the blade 24 to the second position by the coil spring 38, the blade 24 will tend to remain received within the trough 58 as long as action is not taken to operate the actuator in order to overcome the bias of the spring 38 and cause rotation of the blade 24 to its first position.

The bias of the spring 38 is sufficiently strong such that, when the sash 20 is moved to its closed position with the slots in the face plate 66 and bottom of the trough 64 registered, the blade 24 will extend into the slot in the trough 64. This will effect an even more positive preclusion of movement of the sash 20 in a direction perpendicular to a plane defined by the window frame 62. The sash 20 will, thereby, be even more securely disposed to deter unwanted removal.

As will be able to be seen then, unless some positive action is taken to move the blade 24 in a rotational manner to its first position, the blade 24 will be maintained in either its second or third positions. When it is desired, however, to remove or tilt the sash 20, operation of the actuator means (described in detail below) can be initiated to overcome the bias of the coil spring 38 and rotate the blade 24 to its first position. With the blade 24 in this position, there will be no obstruction to rotation of the sash 20 out of its location between the frame 62 or, if desired, removal of the sash 20.

Preferred Actuator Structure(s)

An exemplary latch mechanism having been described, attention can now turn to the actuator structure that effects retraction of the latches. With reference to the exemplary latch elements disclosed above, the actuator structure permits volitional rotation of the blade 24 in the counter clockwise direction, as viewed in FIG. 5; and the other blade 24 (shown on the right side of FIG. 14) in the clockwise direction. The actuator structure includes means for inwardly drawing both ends of the filament 50 which in turn inwardly draw the yokes 42 to effect counter clockwise rotation of the left blade 24 and clockwise rotation of the right blade 24. Of course, other types of latch elements (e.g., linear latch elements) could be used. The details of a preferred actuator are set forth below.

With reference to FIGS. 7–11, a preferred embodiment of the tilt latch actuator of the present invention can now be described. As shown, the preferred actuator is actually employed in combination with an integrated lock/tilt latch assembly 70 for a double-hung window. And it will be assumed for the purpose of describing the preferred embodiment that the window is oriented in the typical fashion such that the sashes move up and down rather than side to side. But those skilled in the art will recognize that the present invention is not limited to double-hung windows or for that matter double-hung windows that are oriented in the typical up-and-down fashion.

Figure 7:
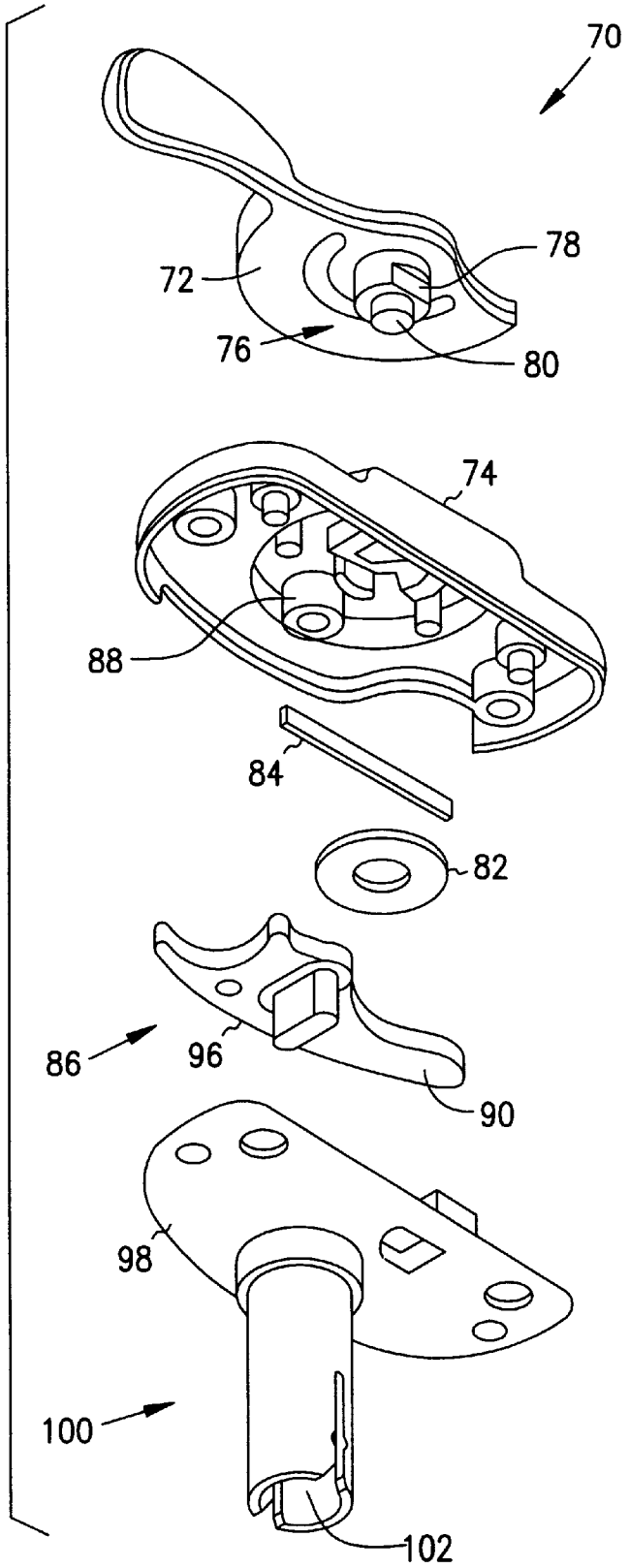
FIG. 7 is an exploded perspective view of a combined window-lock/tilt-latch actuator assembly according to the present invention.
Figure 8:
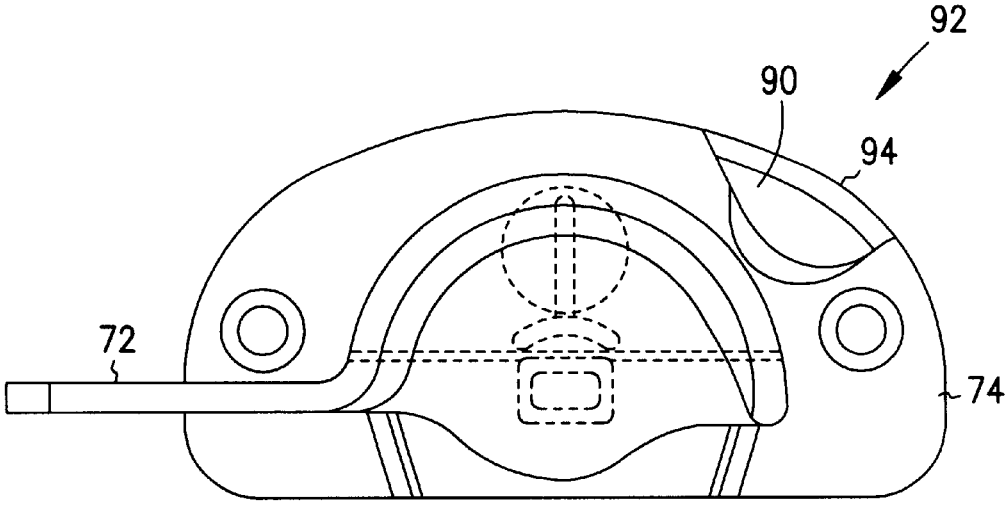
FIG. 8 is a top plan view of the combined window-lock/tilt-latch assembly of FIG. 7, with the sweep and tilt latch lever in their locked positions.
Figure 9:
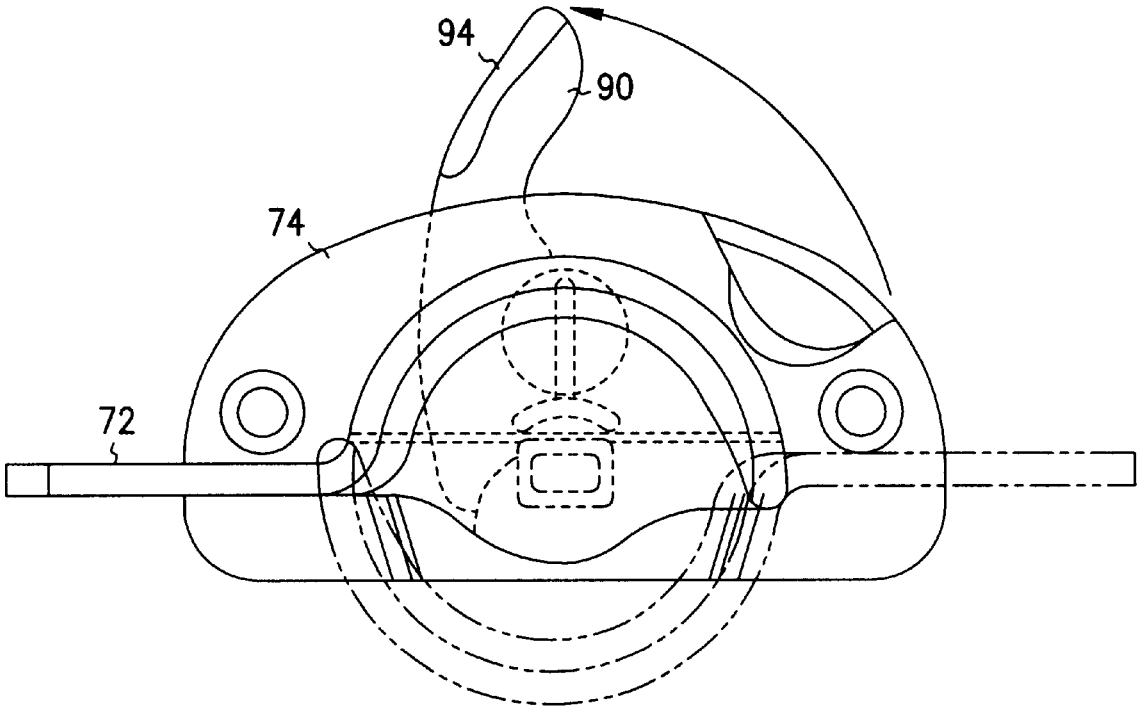
FIG. 9 is a top plan view of the combined window-lock/tilt-latch assembly of FIG. 7, with the tilt latch handle in its unlocked/activated position, and the sweep in its unlocked/activated position in phantom line.

Integrated lock/tilt latch assembly 70 includes, starting at the top of FIG. 7, a traditional rotatable sweep 72 (carried by the lower sash 20) that works in conjunction with a keeper (not shown) attached to the upper sash 22 to lock the lower sash 20 to the upper sash 22 when the sashes are in their fully closed positions and the sweep 72 is in its locked position, as shown in solid line in FIG. 9. Sweep 72 is rotatably supported by a housing 74 in conventional fashion, housing 74 having a generally smooth top surface for supporting the underside of the sweep 72, and a variety of bosses, studs, etc. extending downwardly from its underside for accepting and supporting the various components of the integrated lock/tilt latch 70.

Further with reference to FIG. 7, housing 74 provides a round aperture in its upper surface for receiving the sweep 72. This aperture is located in the middle of the housing, side-to-side, and toward the front of the housing front-to-rear, with the front of the housing normally being mounted adjacent the inside of the room. Depending from the lower surface of the sweep 72 is a generally cylindrical stud 76 that is round at its upper end; has a pair of opposed flats 78 in its middle section; and a reduced diameter round tip 80 at its lower end. After the stud 76 is inserted into the sweep aperture in the housing, a washer-like retainer 82 is fixed to the lower tip 80 of the stud 76, the retainer 82 serving to hold the sweep 72 against the housing 74.

A leaf spring 84 is mounted within the housing 74 in such a way as to resiliently act on the flats 78 in the middle section of the sweep stud 76, so as to tend to maintain the sweep 72 in either its fully unlocked or open position (as shown in phantom line in FIG. 9) or its fully locked or closed position (as shown in solid line in FIG. 9). That is, leaf spring 84 acts against one flat 78 or the other, depending on whether the sweep 72 is fully closed or fully open, to tend to keep the sweep 72 in that position. If the user wishes to rotate the sweep 72 from one position to the other, he or she must overcome the relatively small spring force created by the spring 84.

Still referring to FIG. 7, the underside of the housing 74 also supports a tilt lever 86. The top surface of the tilt lever 86 can carry a short upwardly extending stud (not shown) that can fit within a boss 88 depending from the housing 74. Tilt lever 86 can rotate relative to housing 74, and in fact includes a handle portion 90 that is accessible through a cutout 92 in the rear edge of the housing. Handle portion 90 can include a raised lip 94 on its upper surface, so that the operator can easily get a finger or tool into the cutout 92 and push against the raised lip 94 to initiate the rotation of the tilt lever 86. Once handle portion 90 has "escaped" cutout 92, the operator can gain additional purchase by grasping progressively longer portions of handle 90. As shown in FIG. 9, tilt handle 90 is rotated counter clockwise to actuate the tilt latches 24.

Extending downwardly from the tilt lever is a thin rectangular element 96 that resembles the operating tip of a standard slotted screwdriver.

Tilt lever 86 and the other components mounted to the underside of housing 74 are vertically held in place by a base plate 98 that is fastened to the housing 74 in conventional fashion (e.g., threaded fasteners, staking, rivets). Base plate 98, in plan view, has the same overall shape as housing 74, except that base plate 98 does not have a cutout similar to cutout 92 for access to the handle portion 90 of the tilt lever 86. Base plate 98 is smooth and flat on its bottom surface, to accommodate mounting to sash 20.

Figure 1:
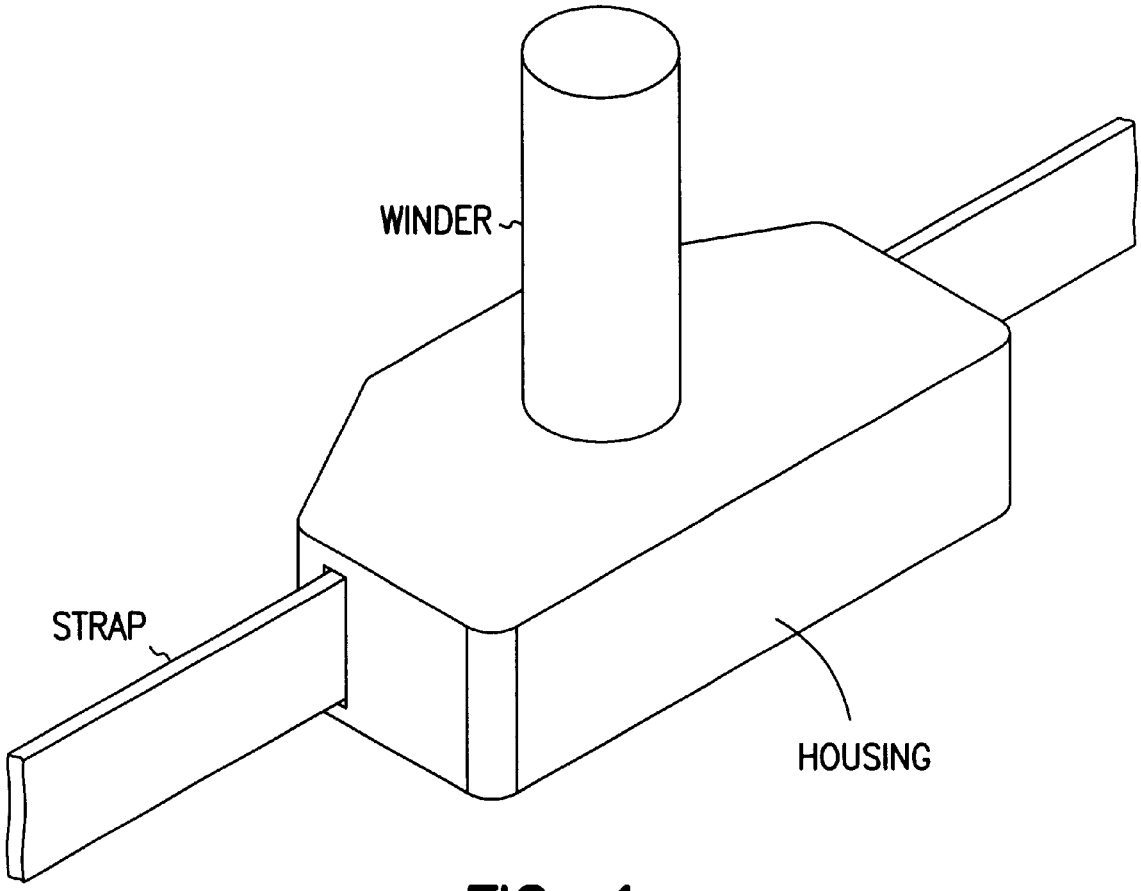
FIG. 1 (PRIOR ART)
FIG. 1 is a perspective pictorial view of a strap-type prior art sash retention mechanism actuator.
Figure 2:
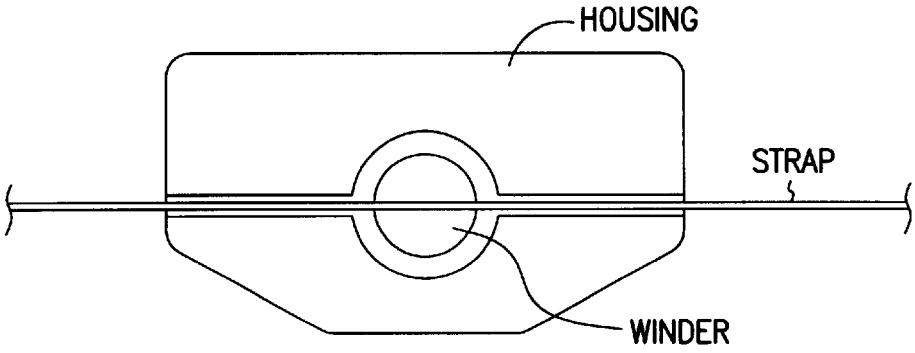
FIG. 2 (PRIOR ART)
FIG. 2 is a bottom plan pictorial view of the prior art strap-type actuator of FIG. 1, with the winder in its unactivated position.
Figure 3:
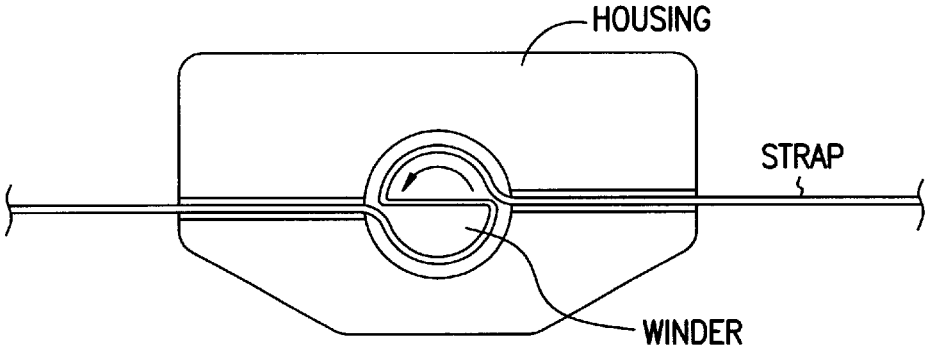
FIG. 3 (PRIOR ART)
FIG. 3 is a bottom plan pictorial view of the prior art strap-type actuator of FIG. 1, with the winder in its activated position.
Figure 4:
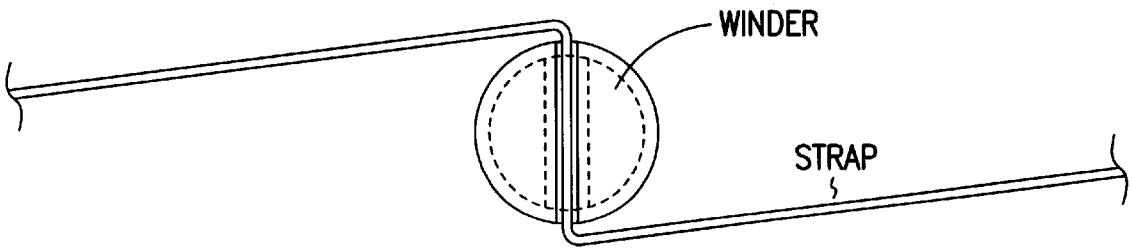
FIG. 4 (PRIOR ART)
FIG. 4 is a bottom plan pictorial view of the prior art strap-type actuator of FIG. 1, with the housing removed and the winder in its activated position.

Extending downwardly from the baseplate 98, and mounted for rotation relative thereto, is a cylindrical tube-like winder 100. That is, winder 100 is supported at its upper end by baseplate 98, and there is no "housing" at the lower end of the winder 100 as in the case of certain prior art actuator mechanisms. Reference is again made to FIG. 1, which shows a prior art winder mechanism having a housing at the lower end of the mechanism to support the winder cylinder. The longitudinal axis of winder 100 about which it rotates, is oriented vertically when the assembly 70 is mounted in typical fashion.

At the lower end of winder 100 is a slit 102 extending through an imaginary vertical axis about which winder 100 rotates. (Slit 102 is typically "vertical" in this description only because it is assumed for the sake of convenience that the double-hung window is oriented in a conventional, vertical manner, with the sashes moving up and down.)

Slit 102 is preferably widest at its very lowest point (i.e., at the lower tip of the winder), and narrows or converges as it extends upwardly, until it reaches a point up the winder where it generally attains a constant width, with one exception. At a small distance above the top of the triangular converging portion of the slit there can be a rounded "bulge" 104 in the slit, for purposes to be described below. And the slit 102 continues above the "bulge" for another small distance. This additional slit, or slit extension, above the bulge 104, can give the structure some degree of springiness, so as to assist in accepting and retaining the cord or filament 50, as further described below. Slit 102 splits the lower end of winder 100 into two "tines" that are resiliently biased toward one another by virtue of the natural resilience of the material fabricated into the two-tine geometry shown and described herein.

Figure 10:
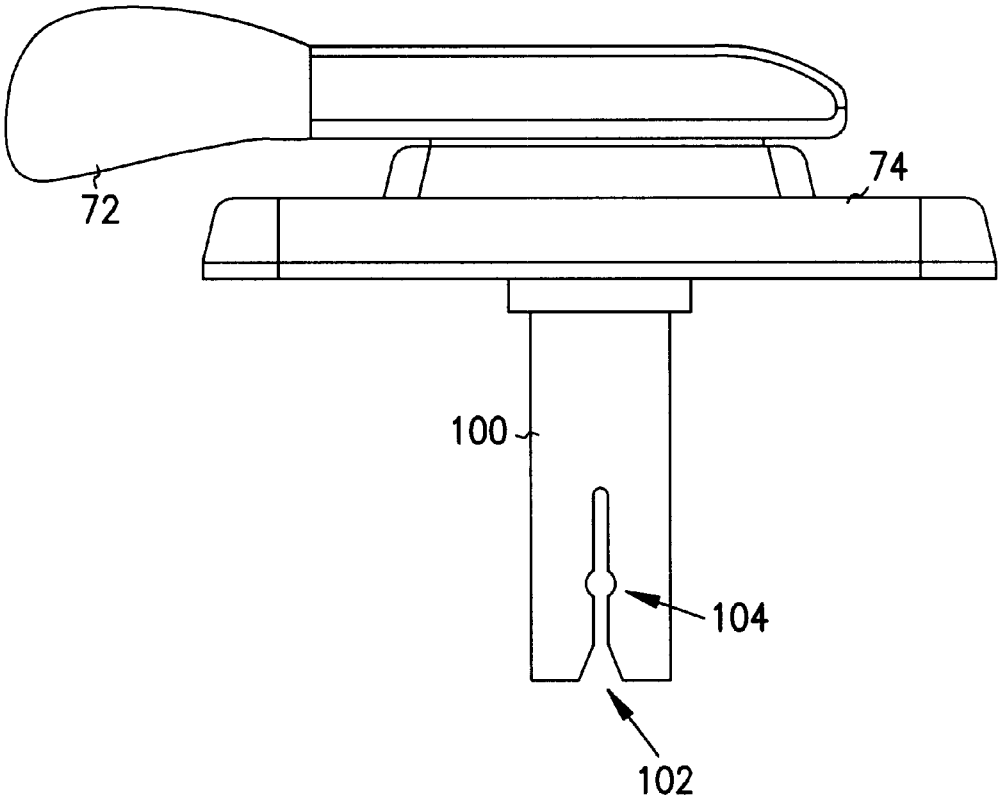
FIG. 10 is a front elevational view of the assembly of FIG. 7, with the sweep and tilt latch handle in their locked/unactivated positions.
Figure 11:
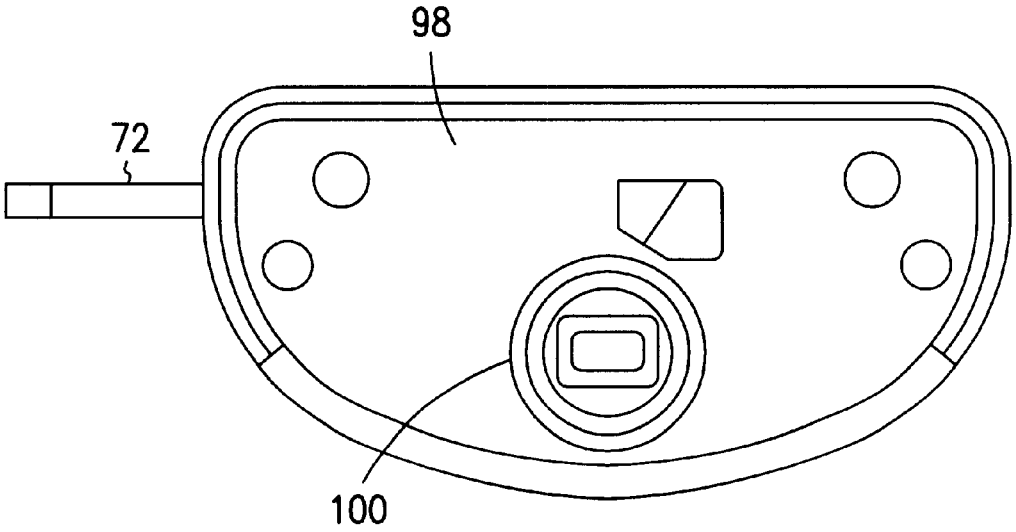
FIG. 11 is a bottom plan view of the assembly of FIG. 7.

Importantly, slit 102 is oriented such that it is generally perpendicular to the panes of glass in the sashes 20,22 when the tilt handle 86 is in its unactivated position, e.g., as shown in FIG. 10. Tilt handle 86 is in an activated position in FIG. 9, i.e., when it is extending away from the rearward edge of the housing 74 and the handle portion 90 is no longer confined within the cutout 92 such as when it is in its unactivated state or position.

Figure 12:
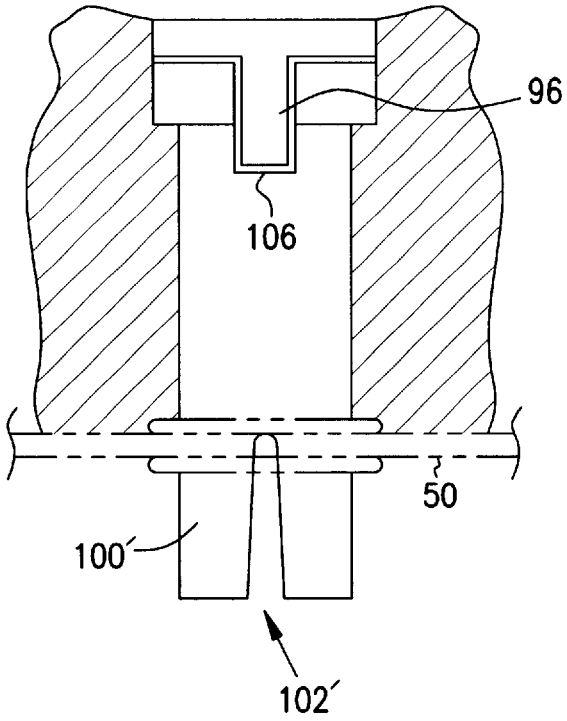
FIG. 12 is an enlarged side elevational view of the cord-retaining end of a second embodiment of a winder according to the present invention, with the winder in its activated/unlocked position and the cord (in phantom) wrapped around the winder.
Figure 13:
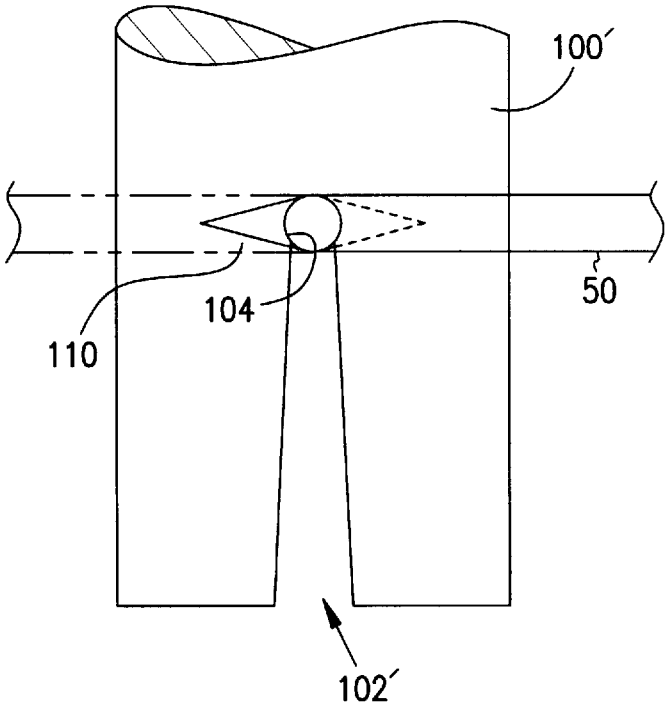
FIG. 13 is an enlarged view of the lower end of the winder of FIG. 12, again showing the cord in phantom but with the winder in its unactivated/locked position and with the cord not wrapped around the winder.

With reference to FIG. 12, the top of the winder 100' also forms a slit 106 for accepting the rectangular element 96 extending downwardly from the tilt lever 86. When element 96 is engaged with slit 106, rotation of tilt lever 86 causes winder 100 to rotate about its longitudinal (in this case vertical) axis. It should be noted that the winder 100' shown in FIGS. 12 and 13 is slightly different from the winder 100 shown in FIGS. 7–11, and hence is labeled 100' for the sake of clarity. The main difference between winder 100 and 100' is the cord slit 102 and 102', respectively, as further discussed below.

The cord or filament 50 can be received within slit 102, 102', depending upon the particular embodiment involved. In either case, however, the slit 102, 102' will have a portion, through which the cord 50 must be passed, to be received within the bulge 104, 104'. With the cord 50 received within the bulge 104, 104', the cord will freely pass back and forth through the bulge 104, 104' of the winder 100. As the winder 100 is rotated, the cord 50 will be coiled about the winder 100. Because of the relative dimensions of the cord 50 and the bulge 104, 104', pressure brought to bear upon each tilt latch assembly 70 will be equalized.

The "bulge" 104 in the winder slit 102 is located roughly at the midpoint between the lower tip of the winder 100 and the upper extent of the slit. Slit 102 is preferably less wide than the distance of the cord 50, while the bulge 104 is preferably wider than the diameter of cord 50. That is, the dimensions of slit 102 are slightly smaller than the diameter of cord 50 except at the bulge 104. These relative dimensions are selected to retain cord 50 in a particular, preferred way: cord 50 has to be pushed up into the lower portion of the slit 102, causing the "tines" of the winder 100 to separate slightly to permit the cord to be pushed up into and received within the bulge 104. Once so located, cord 50, since slightly smaller in diameter than the generally round bulge 104, can slide freely therein in a lateral direction (in a lateral direction (i.e., back and forth in a direction perpendicular to the longitudinal axis of the winder). This permits the actuator to be self-balancing, so that if there is a temporary imbalance as between the force on one end of the cord 50 as compared to the other end, then the cord 50 will slide within the bulge 104 at the start of the winding process so as to balance out the difference in force on the ends of the cord 50.

Figure 14:
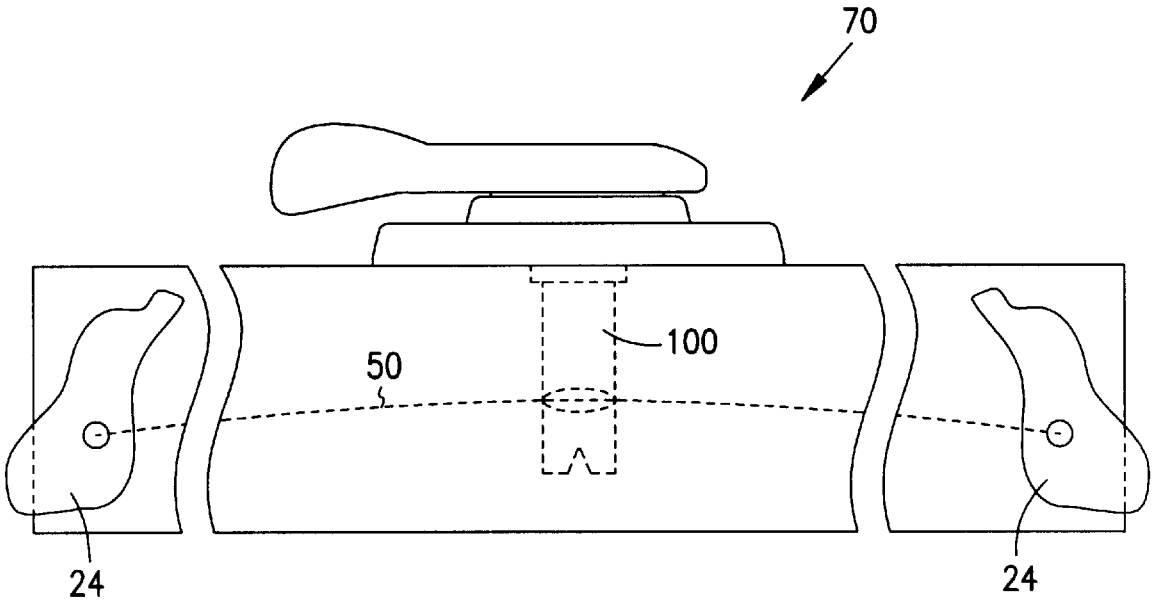
FIG. 14 is a front elevational pictorial view of the actuator of the present invention in conjunction with a pair of latch assemblies mounted in a double-hung window.

This sliding of the cord 50 in the bulge 104 is very useful in terms of permitting a single actuator to actuate dual blades 24. Such a configuration is shown in FIG. 14.

It should again be emphasized that virtually any type of latch element could be used with the actuators of the present invention. The present invention is not limited to pivoting blades such as described herein.

Also, the actuator of the present invention could be in the form of a separate device, and needn't be integrated into the window lock as in the preferred embodiment described herein.

FIG. 13 shows an alternative type of slit 102' in the winder 100'. This slit 102' has the "bulge" 104' located at the very apex of the slit 102', in contrast to slit 102 shown in FIGS. 7–11, wherein the bulge 104 is located approximately midway between the bottom and the top of the slit 102. Also, slit 102' is tapered all the way from its lower end to its upper end. The bulge 104' is again slightly larger than the cord 50, so that the cord can freely slide in the bulge 104' to self balance the ends of the cord 50.

FIGS. 12 and 13 also illustrate small relieved areas or "scallops" 110 on the slits adjacent the bulge 104', which relieve bending stress on the cord 50, to reduce the likelihood that the cord 50 will prematurely break. The scallops 110 also help the cord to freely slide within the bulge 104' during the self balancing process discussed above. It should be noted that scallops 110 could be used with winder 100 as well. The winder 100' shown in FIGS. 12 and 13 is a solid circular rod as opposed to the tubular winder 100 of FIGS. 7–11.

FIG. 14 shows how the self balancing process works. If the cord becomes prematurely taught on the right end because there is slack on the left end, this will cause the cord to slide within the bulge 104 to balance out the actuator system. This prevents one latch 24 from completely retracting into the sash 20, while the other latch 24 remains only partially retracted.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A window assembly comprising:

a window sash slidingly mounted within a window frame, the window sash slides within a first plane;

a housing mounted to the window sash;

a winder rotatably connected to the housing and extending into an interior of the window sash, the winder being rotatable about a longitudinal axid thereof and having an opening extending therethrough, the opening having a longitudinal axis generally perpendicular to said longitudinal axis of said winder; and a flexible cord having a substantially round cross-section, the cord including two ends with each of said ends of the cord connected to a respective one of a pair of sash tilt latches, said cord extending through said opening such that as the winder is rotated in a first direction, the cord coils around the winder to draw the sash tilt latches inwardly, thereby releasing the window sash from the window frame, the cord having an outer cord diameter smaller than at least a portion of the opening such that the cord does not bind in and passes freely through the portion of the opening of the winder;

wherein the winder has a distal end and a proximal end coupled with the housing, the winder having an intermediate portion therebetween.

2. The window assembly as recited in claim 1, wherein the sash tilt latches comprise planar blade members.

3. The window assembly as recited in claim 1, wherein the opening includes a slot, and a width of the slot is non uniform.

4. The window assembly as recited in claim 3, wherein the slot converges to said portion of said opening which comprises a rounded slot portion, and the non uniform slot extends towards the proximal end of the winder from the rounded slot portion.

5. The window assembly as recited in claim 4, further comprising scallops adjacent to the rounded slot portion.

6. The window assembly as recited in claim 1, wherein the winder is solid.

7. The window assembly as recited in claim 1, wherein the winder is tubular.

8. The window assembly as recited in claim 1, wherein the portion of the opening comprises a rounded opening at the intermediate portion of the winder.

9. The window assembly as recited in claim 1, wherein the cord is self-balancing.

10. The window assembly as recited in claim 1, further comprising a locking member rotatably coupled relative to the housing.

11. The window assembly as recited in claim 1, further comprising a means for preventing unwanted removal of the sash from the frame.

12. A window assembly comprising:

a housing mounted on an outer surface of a window sash, the window sash is mounted in a window frame and slides within a first plane;

a winder rotatably connected to the housing and extending from the housing into an interior of the window sash; and a flexible filament connected to the latch elements and passing through an opening in a pair of tilt winder, and rotating the winder causes the filament to wrap around the winder to selectively draw the latch elements into the window sash, thereby permitting the window sash to be removed from the window frame, the filament having an outer diameter smaller than at least a portion of the opening such that the cord does not bind in and passes freely through the portion of the opening of the winder, the winder being rotatable about a longitudinal axis thereof which is parallel to said first plane.

13. The window assembly as recited in claim 12, wherein the flexible filament is self balancing.

14. The window assembly as recited in claim 12, wherein the winder has a distal end and a proximal end coupled with the housing, the winder having an intermediate portion therebetween, the opening including a diametral slot, and a width of the slot varies between the intermediate portion and the distal end.

15. The window assembly as recited in claim 12, further comprising a locking member rotatably coupled with the housing.

16. The window assembly as recited in claim 12, further comprising a tilt lever coupled with the winder, where the tilt lever includes a raised lip.

17. The window assembly as recited in claim 12, wherein the flexible filament comprises a cord.

18. The window assembly as recited in claim 12, wherein the portion of the opening comprises a rounded portion.

19. The window assembly as recited in claim 12, wherein the flexible filament includes a cord between the pair of latch elements.

* * * * *

UNITED STATES PATENT AND TRADEMARK OFFICE

CERTIFICATE OF CORRECTION

PATENT NO. : 6,588,150 B1 
DATED : July 8, 2003
INVENTOR(S) : Leslie B. Hendrickson and Lenny Wong It is certified that error appears in the above-identified patent and that said Letters Patent is hereby corrected as shown below:

Column 9,
Line 64, delete “axid” and insert -- axis -- therefor.

Column 10,
Line 49, delete “the” before “latch” and insert -- a pair of tilt -- therefor.
Line 50, delete “a pair of tilt” and insert -- the -- therefor.

Column 12,
Line 5, insert -- coupled -- after “cord”.

Signed and Sealed this

Sixth Day of January, 2004

JAMES E. ROGAN
*Director of the United States Patent and Trademark Office*